US009561670B2

(12) United States Patent
Hirata

(10) Patent No.: US 9,561,670 B2
(45) Date of Patent: Feb. 7, 2017

(54) IMAGE RECORDING APPARATUS

(71) Applicant: BROTHER KOGYO KABUSHIKI KAISHA, Nagoya-shi, Aichi-ken (JP)

(72) Inventor: Kenichi Hirata, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/083,841

(22) Filed: Mar. 29, 2016

(65) Prior Publication Data

US 2016/0288534 A1 Oct. 6, 2016

(30) Foreign Application Priority Data

Mar. 31, 2015 (JP) ..... 2015-071947

(51) Int. Cl.
*B41J 13/00* (2006.01)
*B41J 11/00* (2006.01)

(52) U.S. Cl.
CPC ..... *B41J 11/007* (2013.01); *B41J 13/009* (2013.01); *G03G 2215/00675* (2013.01)

(58) Field of Classification Search
CPC ..... B41J 13/009; B41J 11/007; G03G 2215/00675
See application file for complete search history.

(56) References Cited

U.S. PATENT DOCUMENTS

2008/0107446 A1* 5/2008 Ohtsuki ..... G03G 15/70 399/124
2009/0073211 A1* 3/2009 Imoto ..... B41J 11/0005 347/16
2012/0139178 A1* 6/2012 Silberbauer ..... B65H 5/32 270/20.1

FOREIGN PATENT DOCUMENTS

JP 63-251267 A 10/1988
JP 5-201601 A 8/1993
JP 2007-176695 A 7/2007
JP 3169690 U 7/2011

* cited by examiner

*Primary Examiner* — Alessandro Amari
*Assistant Examiner* — Yaovi M Ameh
(74) *Attorney, Agent, or Firm* — Merchant & Gould P.C.

(57) ABSTRACT

An image recording apparatus includes a rotational tray including a supporting surface for supporting a recording medium and a retaining mechanism. The rotational tray is attached to the housing to be rotatable so that an angle between the rotational tray and a side surface of the housing is changeable. The retaining mechanism is able to retain the rotational tray in one of: an open state in which a second discharging slot formed in the side surface of the housing is opened and the recording medium discharged from the second discharging slot is supportable by the supporting surface; a closed state in which the second discharging slot is closed by the supporting surface; and an intermediate state between the open state and the closed state, in which the recording medium discharged from the second discharging slot can be guided in a direction along the supporting surface.

4 Claims, 8 Drawing Sheets

IMAGE RECORDING APPARATUS

CROSS REFERENCE TO RELATED APPLICATION

The present application claims priority from Japanese Patent Application No. 2015-071947, which was filed on Mar. 31, 2015, the disclosure of which is herein incorporated by reference in its entirety.

BACKGROUND OF THE INVENTION

1. Field of the Invention

The present invention relates to an image recording apparatus.

2. Description of Related Art

A known printer includes a face-up sheet discharge tray provided on a side wall of a housing and a face-down sheet discharge tray provided on an upper wall of the housing. In such a printer, for example, an upstream conveyance passage and two downstream conveyance passages may be formed. The upstream conveyance passage passes an image formation position where image formation on a recording medium is performed by an image formation unit. The two downstream conveyance passages are connected to an end of the upstream conveyance passage and guide recording sheets to the two sheet discharge trays, respectively. The conveyance destination of a recording sheet conveyed on the upstream conveyance passage is switchable by a flapper between the two downstream conveyance passages. On each of these three conveyance passages, a conveyor roller (sheet discharge roller) is provided to convey recording sheets.

In the printer above, while the downstream conveyance passage for guiding a recording sheet to the face-down sheet discharge tray may be a curved conveyance passage having a curved part which is curved, the downstream conveyance passage for guiding a recording sheet to the face-up sheet discharge tray may be a linear conveyance passage which is substantially linear in shape. In this printer, a recording sheet with at least a predetermined degree of flexibility is discharged to the face-down sheet discharge tray via the curved conveyance passage. In the meanwhile, a recording sheet without at least the predetermined degree of flexibility is discharged to the face-up sheet discharge tray via the linear conveyance passage.

In regard to the above, in the printer above, when the leading end of a recording sheet is arranged to reach the conveyor roller on the downstream conveyance passage while an image is being recorded on that recording sheet, the conveyance force of the conveyor roller is applied to the recording sheet on which the image is being recorded. In this case, if the conveyance speed of the conveyor roller on the downstream conveyance passage is arranged to be equal to or higher than the conveyance speed of the conveyor roller on the upstream conveyance passage, the recording sheet is pulled downstream after the leading end of the recording sheet reaches the conveyor roller provided on the downstream conveyance passage. As a result, the recording position of the image on the recording sheet recorded by the image formation unit is deviated, and hence the quality of the image recorded on the recording sheet is deteriorated.

For this reason, in the printer above, the conveyance speed of the conveyor roller provided on the curved conveyance passage on which a flexible recording sheet is conveyed is arranged to be lower than the conveyance speed of the conveyor roller provided on the upstream conveyance passage. As the conveyance speeds are arranged in this way, when an image is recorded on a flexible recording sheet, the recording sheet is warped between the conveyor roller on the upstream conveyance passage and the conveyor roller on the curved conveyance passage, with the result that the recording sheet is not pulled downstream and hence the deterioration in the quality of the image recorded on the recording sheet is restrained. In this regard, the conveyance speed of the conveyor roller provided on the linear conveyance passage on which a recording sheet without at least the predetermined degree of flexibility is conveyed is arranged to be substantially identical with the conveyance speed of the upstream conveyor roller, because, for example, the recording sheet cannot be warped.

An image recording apparatus is preferably able to record an image on a recording sheet which is longer than a regular recording sheet. In the printer above, provided that the conveyance speed of the conveyor roller provided on each conveyance passage is arranged as described above, when a long recording sheet is discharged to the face-down sheet discharge tray via the curved conveyance passage, the amount of warpage of the recording sheet between the conveyor rollers is larger than the amount of warpage of a regular recording sheet. The inventor of the subject application has found that, when an image is formed at around the tail end of such a recording sheet by the image formation unit, the quality of the image recorded on the recording sheet is deteriorated on account of a large amount of warpage of the recording sheet.

In the meanwhile, when a long recording sheet is discharged to the face-up sheet discharge tray provided on the side wall of the housing, the deterioration in the quality of the image recorded on the recording sheet is restrained as compared to the case where the recording sheet is discharged to the face-down sheet discharge tray. However, a large space to which a long recording sheet is discharged must be provided at a side of the housing, with the result that the installation space of the image recording apparatus is large.

SUMMARY OF THE INVENTION

An object of the present invention is to provide an image recording apparatus which is able to restrain the deterioration in quality of an image recorded on a long recording medium and requires a small installation space.

An image recording apparatus of the present invention includes: a conveyance mechanism configured to convey a recording medium in a conveyance direction; an image recording mechanism configured to record an image onto the recording medium conveyed by the conveyance mechanism; a housing which houses the conveyance mechanism and the image recording mechanism; a rotational tray which includes a supporting surface for supporting the recording medium and is attached to the housing to be rotatable with an angle between the rotational tray and a side surface of the housing being changeable; and a retaining mechanism which is able to retain the rotational tray in one of rotation states which are different from one another in the angle with respect to the side surface. The conveyance mechanism includes: a first conveyor which includes a first conveyance passage which is linear in shape and passes a recording position where the image is recorded onto the recording medium by the image recording mechanism, the first conveyor being configured to convey the recording medium at a first conveyance speed along the first conveyance passage; a second conveyor which includes a first discharging slot formed in an outer wall of the housing and a second conveyance passage extending from an end of the first conveyance passage to the first discharging slot and being at least partially curved, the second conveyor being configured to convey the recording medium along the second conveyance passage at a second conveyance speed lower than the first conveyance speed; a third conveyor which includes a second discharging slot formed in the side surface of the housing and a third conveyance passage which extends from the end of the first conveyance passage to the second discharging slot, is in parallel to the first conveyance passage, and is linear in shape, the third conveyor being configured to convey the recording medium along third conveyance passage at a third conveyance speed which is less different from the first conveyance speed than the second conveyance speed is from the first conveyance speed; and a switcher configured to switch a conveyance destination of the recording medium conveyed on the first conveyance passage between the second conveyance passage and the third conveyance passage. The retaining mechanism is configured to retain the rotational tray in one of: an open state in which the second discharging slot is opened and the recording medium discharged from the second discharging slot is supportable by the supporting surface; a closed state in which the second discharging slot is closed by the supporting surface; and an intermediate state between the open state and the closed state, in which the recording medium discharged from the second discharging slot is allowed to be guided in a direction along the supporting surface.

DESCRIPTION OF THE PREFERRED EMBODIMENTS

Figure 1:
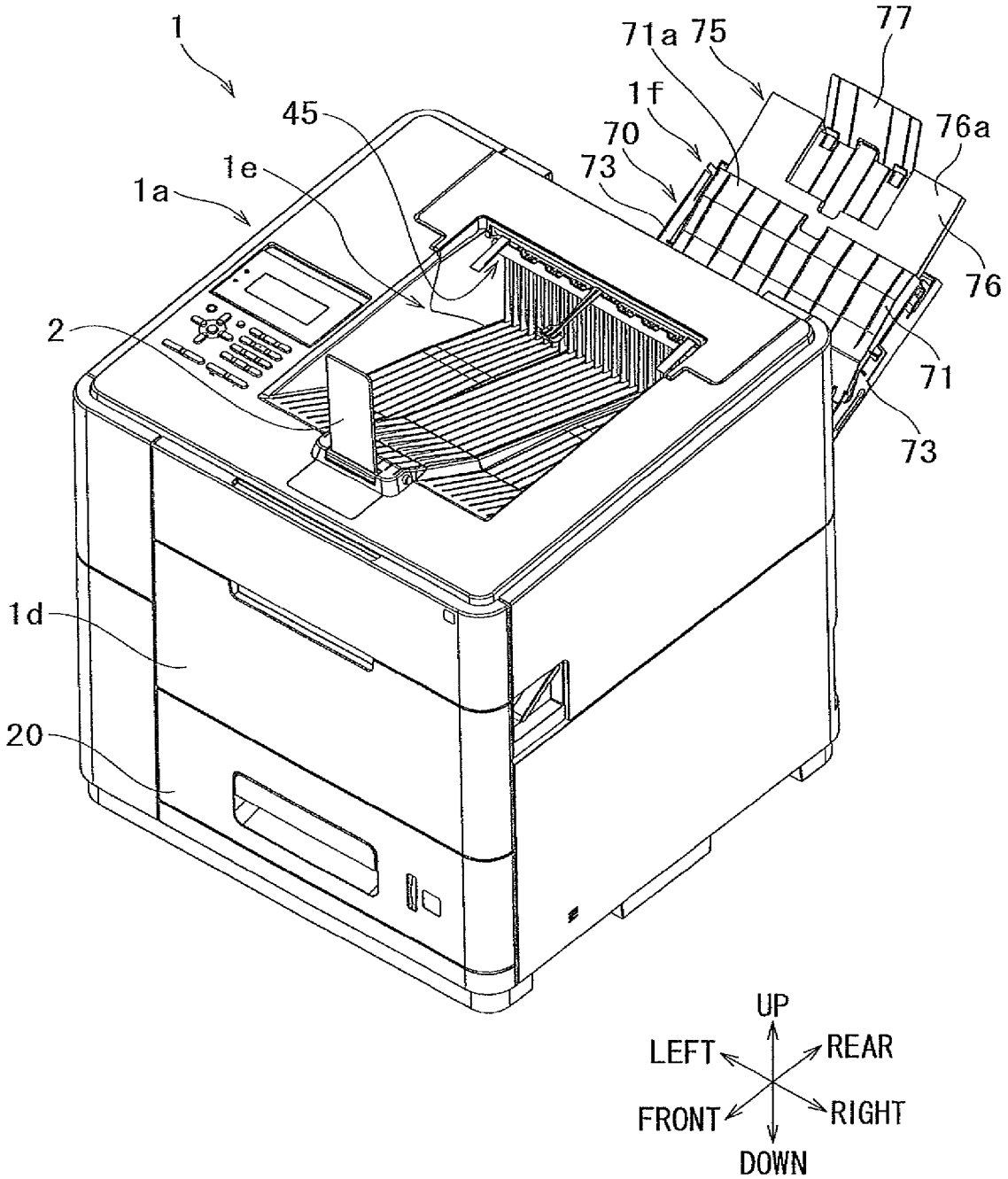
FIG. 1 is an oblique perspective of an inkjet printer of an embodiment of the present invention.

The following will describe a preferred embodiment of the present invention with reference to figures. To begin with, referring to FIG. 1 and FIG. 2, the overall configuration of an inkjet printer 1 of the embodiment of the present invention will be described. Hereinafter, upward and downward directions in a state in which the printer 1 is installed to be ready to use (i.e., the state shown in FIG. 1) are defined as upward and downward directions of the present embodiment. Furthermore, a direction from a rear cover if toward a front cover 1*d* is defined as a frontward direction, whereas a direction from the front cover 1*d* toward the rear cover if is defined as a rearward direction. Leftward and rightward directions when the printer 1 is viewed from the front side are defined as leftward and rightward directions.

The printer 1 includes a housing 1*a* which is rectangular parallelepiped in shape. On the upper surface of a top plate of the housing 1*a*, a first discharging slot 45, a first sheet discharge tray 1*e*, and a stopper 2 are provided. The first discharging slot 45 is an opening through which a sheet P is discharged from the inside of the housing 1*a* to the outside of the housing 1*a*, and is formed at a rear end portion of the upper surface of the top plate of the housing 1*a*. The first sheet discharge tray 1*e* is formed of an upper wall of the housing 1*a* and is able to support the sheet P discharged from the first discharging slot 45.

The stopper 2 is a rectangular flat plate with which the sheet P discharged from the first discharging slot 45 collides. The stopper 2 is configured to be able to take one of a plurality of rotation states including a stand-up state (see FIG. 1) and a laid-down state (see FIG. 2) by rotating about a rotational shaft (not illustrated) which is provided at the leading end portion of the upper surface of the top plate of the housing 1*a* and extends in the left-right direction. In the stand-up state, the stopper 2 is arranged to intersect with a horizontal plane and oppose the first discharging slot 45. As a result, the sheet P discharged from the first discharging slot 45 collides at its leading end with the stopper 2 and is bounced, and consequently falls on a first sheet discharge tray 1*e* provided between the first discharging slot 45 and the stopper 2.

At a lower part of the inside of the housing 1*a*, a sheet feeding tray 20 is housed. This sheet feeding tray 20 is an open-top box and capable of storing plural sheets P which are relatively flexible sheets such as regular sheets. This sheet feeding tray 20 is arranged to be attachable to and detachable from the housing 1*a* in a front-rear direction (the left-right direction in the plane of FIG. 2).

In the front surface of the housing 1*a*, a supply opening 51 (see FIG. 2) for supplying the sheet P into the housing 1*a* is formed. Furthermore, to the housing 1*a*, the front cover 1*d* is attached to be rotatable (openable and closable). The angle of the front cover 1*d* is therefore changeable with respect to the front surface of the housing 1*a*. This front cover 1*d* is arranged to take a closed state (see FIG. 1 and FIG. 2) in which the supply opening 51 is closed or an open state (see FIG. 3B) in which the supply opening 51 is opened. The front cover 1*d* is further provided with a manual feed tray 50. The manual feed tray 50 is able to support the sheet P supplied to the supply opening 51, when the front cover 1*d* is in the open state. On this manual feed tray 50, sheets P which are relatively less flexible such as postcards and cardboards, sheets P which are longer than the sheets P stored in the sheet feeding tray 20, and the like can be placed. By setting the front cover 1*d* in the open state and places a sheet P on the manual feed tray 50, a user is able to supply the sheet P into the housing 1*a* from the front side of the apparatus, without using the sheet feeding tray 20.

In the rear surface of the housing 1*a*, a second discharging slot 46 (see FIG. 2) is formed. Furthermore, the housing 1*a* is provided with a pair of supporting frames 6 (see FIG. 6A to FIG. 6C) which oppose each other in the left-right direction. The pair of the supporting frames 6 is, on the rear side of the housing 1*a*, provided to be sandwiched by side walls in the left-right direction of the housing 1*a*. To the pair of the supporting frames 6, the rear cover if is attached to be rotatable (openable and closable). The angle of the rear cover if is therefore changeable with respect to the rear surface of the housing 1*a*. By a later-described retaining mechanism 60, the rear cover if can be retained in one of three rotation states, namely a closed state (see FIG. 2) in which the second discharging slot 46 is closed, an open state (see FIG. 3A) in which the second discharging slot 46 is opened, and an intermediate state (see FIG. 3B) which is between the open state and the closed state. This rear cover if is provided with a second sheet discharge tray 70 (rotational tray). When the rear cover if is in the open state, the second sheet discharge tray 70 is able to support the sheet P discharged from the second discharging slot 46. The retaining mechanism 60 and the rear cover if will be detailed later.

In the housing 1*a*, apart from the sheet feeding tray 20, two heads 10 (image recording mechanisms), two cartridges (not illustrated) corresponding to the respective two heads 10, a conveyance mechanism 5, a controller 100 configured to control members in the printer 1, and the like are stored. In this housing 1*a*, conveying paths R1 to R5 on which the sheet P is conveyed are formed.

Figure 2:
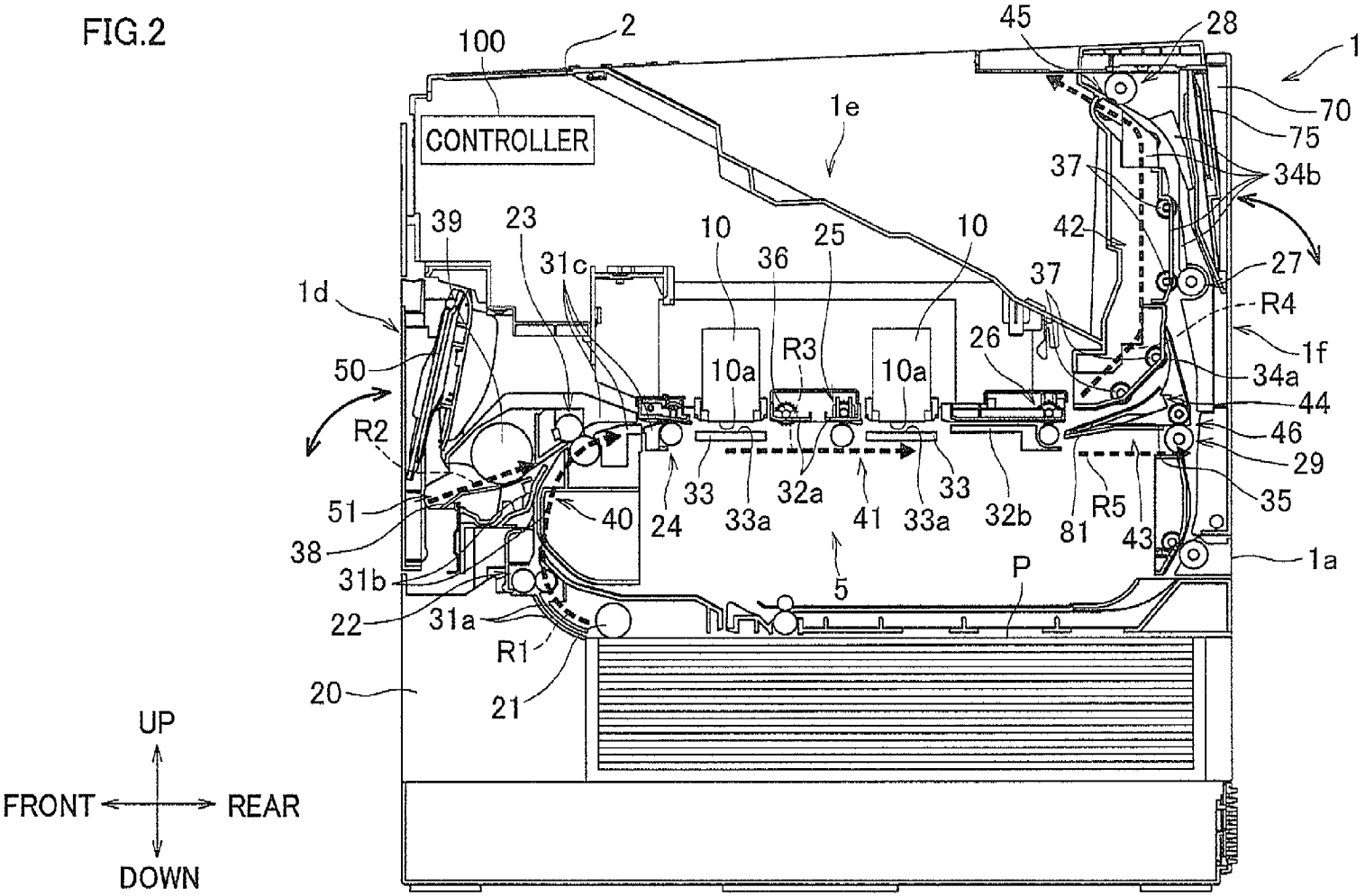
FIG. 2 is a schematic profile of the inside of the printer shown in FIG. 1.
Figure 3A:
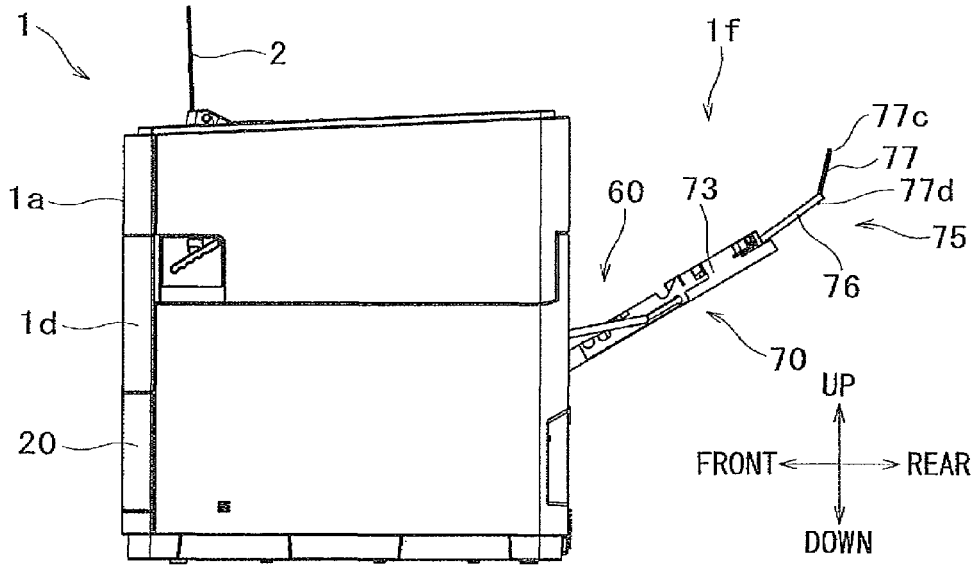
FIG. 3A is a profile of the inkjet printer when a rear cover is in an open state.

As shown in FIG. 2, the two heads 10 are separated from each other in the front-rear direction. In the conveyance direction of the sheet P, the upstream head 10 is a pre-coat head configured to eject preprocessing liquid, and the downstream head 10 is an inkjet head configured to eject black ink. The heads 10 are identical in structure, and each of the heads 10 is a line-type head which is long in the left-right direction (the direction orthogonal to the plane of FIG. 2) and has a substantially rectangular outer shape. The lower surface of each head 10 functions as an ejection surface 10*a* in which a plurality of ejection openings are formed. In each head 10, passages reaching the ejection openings, from which the preprocessing liquid or the black ink supplied from the cartridge is ejected, are formed. The preprocessing liquid has a function of preventing blur and strike-through of the ink, a function of improving color development and quick drying of the ink, or the like.

As shown in FIG. 2, the conveyance mechanism 5 is configured to convey the sheet P in the conveyance direction and includes a feeder 40, a first conveyor 41, a second conveyor 42, a third conveyor 43, and a switcher 44.

The feeder 40 includes two conveying paths R1 and R2, two pickup rollers 21 and 39, and three roller pairs 22 to 24. The conveying path R1 extends from the sheet feeding tray 20 to a recording position (which is a position opposing the ejection surface 10*a*) and is curved to form a U-shape when viewed in the left-right direction. This conveying path R1 is formed of guides 31*a* to guide 31*c*. The conveying path R2 extends from the manual feed tray 50 to the downstream in the conveyance direction of the conveying path R1 when the front cover 1*d* is in the open state, and is formed of a guide 38.

The pickup roller 21 is rotationally driven under the control of the controller 100, and sends out the topmost one of the sheets P stored in the sheet feeding tray 20 to the conveying path R1. The pickup roller 39 is rotationally driven under the control of the controller 100, and sends out the topmost one of the sheets P supported by the manual feed tray 50 to the conveying path R2. The roller pairs 22 to 24 are rotationally driven under the control of the controller 100 and convey the sheet P sent out from the sheet feeding tray 20 or the manual feed tray 50 along the conveying path R1, and pass the sheet P to the conveying path R3.

The first conveyor 41 includes the conveying path R3, roller pairs 25 and 26, and a press down roller 36. The conveying path R3 (first conveyance passage) is a linear conveying path which passes the recording positions of the respective two heads 10 and is in parallel with each ejection surface 10*a* (horizontal plane). The conveying path R3 is formed of guides 32*a* and 32*b* and two platens 33. The two platens 33 correspond to the two heads 10, respectively, and each of the platens 33 is provided with a supporting surface 33*a* which supports the sheet P while opposing the ejection surface 10*a* in the vertical direction. The roller pairs 25 and 26 are provided in this order along the conveying path R3. The roller pairs 25 and 26 are rotationally driven under the control of the controller 100, and convey the sheet P sent from the conveying path R1 along the conveying path R3 and passes the sheet P to the conveying path R4 or the conveying path R5. The press down roller 36 has a function of guiding the sheet P so that the sheet P is conveyed along the conveying path R3.

The second conveyor 42 includes the first discharging slot 45, the conveying path R4 (second conveyance passage), roller pairs 27 and 28, and a plurality of press down rollers 37. The first discharging slot 45 is an opening formed in the outer wall of the housing 1*a* which is the upper surface of the top plate, as described above. The conveying path R4 extends from the end of the conveying path R3 to the first discharging slot 45 and is curved to be U-shaped when viewed in the left-right direction. This conveying path R4 is formed of guides 34*a* and 34*b*.

The conveying path R4 is on the upper side of the recording position (i.e., on the same side as the ejection surface 10*a* relative to the recording position), and is curved in the direction opposite to the conveying path R1. In other words, as shown in FIG. 2, while the conveying path R1 is curved to bulge leftward (so that the bottom of the U-shape is on the left side), the conveying path R4 is curved to bulge rightward (so that the bottom of the U-shape is on the right side). With this, the conveying paths R1, R3, and R4 form a reverse S-shape on the whole.

The roller pairs 27 and 28 are provided in this order along the conveying path R4. The roller pairs 27 and 28 are rotationally driven under the control of the controller 100, and convey the sheet P sent from the conveying path R3 along the conveying path R4 and discharge the sheet P from the first discharging slot 45 to the outside of the housing 1*a*. The sheet P discharged from the first discharging slot 45 collides with the stopper 2 in the stand-up state, and then falls on the first sheet discharge tray 1*e* and is supported thereby. The support rollers 37 are provided along the conveying path R4 and have a function of guiding the sheet P so that the sheet P is conveyed along the conveying path R4.

The third conveyor 43 includes the second discharging slot 46, the conveying path R5 (third conveyance passage), and a roller pair 29. The second discharging slot 46 is an opening formed in the rear surface of the housing 1*a* and is provided for discharging the sheet P from the inside of the housing 1*a* to the outside of the housing 1*a*. The conveying path R5 is a linear conveying path extending from the tail end of the conveying path R3 to the second discharging slot 46. This conveying path R5 is in parallel to the conveying path R3, i.e., is in parallel to each ejection surface 10*a*. The conveying path R5 is formed of the guide 35. The roller pair 29 is rotationally driven under the control of the controller 100, and conveys the sheet P sent from the conveying path R3 along the conveying path R5 and discharges the sheet P from the second discharging slot 46 to the outside of the housing 1*a*.

In the present embodiment, the conveyance mechanism 5 is arranged so that, when the leading end of a standard-sized sheet P such as a regular sheet or a long sheet P is at the conveying path R4 or the conveying path R5, the rear end portion of that sheet P is at the recording position.

The switcher 44 switches the conveyance destination of the sheet P conveyed on the conveying path R3 between the conveying path R4 and the conveying path R5. In the present embodiment, the switcher 44 is arranged to mechanically change the conveyance destination due to the rotation of the rear cover 1*f*. The structure of the switcher 44 will be described later.

Based on a recording command from an external apparatus (such as a PC connected to the printer 1), the controller 100 controls operations such as a preparation operation concerning image recording, a supply-conveyance-discharge operation for the sheet P, and a liquid ejection operation performed in sync with the conveyance of the sheet P, in order to record an image on the sheet P. In addition to a CPU (Central Processing Unit) which is a processing unit, the controller 100 includes members such as a ROM (Read Only Memory), a RAM (Random Access Memory), an ASIC (Application Specific Integrated Circuit), an I/F (Interface), an I/O (Input/Output Port), and a timer. The ROM stores programs executed by the CPU, sets of fixed data, or the like. The RAM temporarily stores data (e.g., image data) required for executing a program. The ASIC rewrites or rearranges sets of image data (e.g., signal processing and image processing). The I/F transmits and receives data to and from an external apparatus. The I/O performs input and output of detection signals to and from sensors. Alternatively, the controller 100 may not include the ASIC, and the image data may be rewritten or rearranged by a program executed by the CPU.

The CPU executes an image recording process and a conveying process based on the programs stored in the ROM. In the image recording process, based on image data, the CPU controls the two heads 10 so that liquid is ejected onto the sheet P conveyed along the conveying path R3. To be more specific, when the sheet P passes a position (recording position) directly below each head 10 while being supported by the supporting surface 33*a* of the platen 33, the head 10 is driven to eject the liquid to the sheet P from the ejection openings of the ejection surface 10*a*. As a result, an image is recorded on the sheet P.

In the conveying process, the CPU controls the pickup roller 21 so that a sheet P stored in the sheet feeding tray 20 is sent out to the conveying path R1 or controls the pickup roller 39 so that a sheet P placed on the manual feed tray 50 is sent out to the conveying path R2. Furthermore, while the head 10 is performing recording on the sheet P, the CPU controls the roller pairs 21 to 29 so that the sheet P does not stop and is conveyed along the conveying path.

In the present embodiment, when an image is recorded on a relatively flexible sheet P stored in the sheet feeding tray 20, the sheet P is conveyed to the conveying paths R1, R3, and R4 in this order, and the sheet P on which the image is recorded is discharged from the first discharging slot 45. In other words, the conveyance destination of the sheet P conveyed on the conveying path R3 is set to the conveying path R4 by the switcher 44. Furthermore, the conveyance speed V1 of the sheet P conveyed by the roller pairs 25 and 26 of the first conveyor 41 is arranged to be lower than the conveyance speed V2 of the sheet P conveyed by the roller pairs 27 and 28 of the second conveyor 42.

This is because, by arranging the conveyance speed V2 to be lower than the conveyance speed V1, the sheet P is warped between the roller pair 26 (first conveyor 41) and the roller pair 27 (second conveyor 42) in order to prevent the sheet P from being pulled downstream in the conveyance direction. With this, the occurrence of deviation in the recording position where the image is recorded on the sheet P (i.e., deviation of dots) is restrained. Furthermore, because the sheet P conveyed on the curved conveying path R4 is curved while being conveyed, the warpage of the sheet P is certainly allowed, and hence the prevention of the occurrence of deviation in the recording position where the image is recorded on the sheet P is ensured.

In the meanwhile, when an image is recorded on a relatively less flexible sheet P placed on the manual feed tray 50, the sheet P is conveyed to the conveying path R2, R1 (partially), R3, and R5 in this order, and the sheet P on which the image is recorded is discharged from the second discharging slot 46. In other words, the conveyance destination of the sheet P conveyed on the conveying path R3 is set to the conveying path R5 by the switcher 44. Furthermore, the conveyance speed V1 of the sheet P conveyed by the roller pairs 25 and 26 of the first conveyor 41 and the conveyance speed V3 of the sheet P conveyed by the roller pair 29 of the third conveyor 43 are arranged to be substantially identical. In other words, the difference between the conveyance speed V3 and the conveyance speed V1 is arranged to be smaller than the difference between the conveyance speed V2 and the conveyance speed V1. This is because, for reasons such as difficulty in warping a relatively less flexible sheet P, the sheet P is conveyed along the substantially linear conveying paths R3 and R5 and the conveyance speeds when the sheet P is conveyed on the conveying paths R3 and R5 are arranged to the substantially identical, so that significant curving of the sheet P is restrained. As a variation, the conveyance speed V1 may be identical with the conveyance speed V3.

When an image is recorded on a long sheet P, if this long sheet P is a relatively flexible sheet P, one might consider that the deterioration in the quality of the image formed on the sheet P is further restrained by setting the conveyance destination of the sheet P conveyed on the conveying path R3 to the conveying path R4 and causing the second conveyor 42 to convey the sheet P, because the sheet P can be warped. However, the inventor of the present invention has found that, when a relatively flexible long sheet P is conveyed by the second conveyor 42, the amount of warpage of the sheet P between the roller pair 26 (first conveyor 41) and the roller pair 27 (second conveyor 42) is large as compared to regular sheets. On this account, when the image is recorded at around the rear end portion of the sheet P (i.e., when the rear end portion of the sheet P is at the recording position), the quality of the image recorded on the sheet P is significantly deteriorated (i.e., the deviation of the recording position is significant) due to the large amount of warpage of the sheet P.

For the reason above, in the present embodiment, when an image is recorded onto a long sheet P placed on the manual feed tray 50, the conveyance destination of the sheet P conveyed on the conveying path R3 is set to the conveying path R5, and the sheet P is discharged from the second discharging slot 46. This restrains the deterioration in the quality of the image recorded on the long sheet P. However, when such a long sheet P is discharged from the second discharging slot 46 to the second sheet discharge tray 70 of the rear cover if in the open state, it is necessary to arrange, for example, the second sheet discharge tray 70 to be long in accordance with the long sheet P, and hence a large space must be secured to the rear of the housing 1*a*.

Figure 3B:
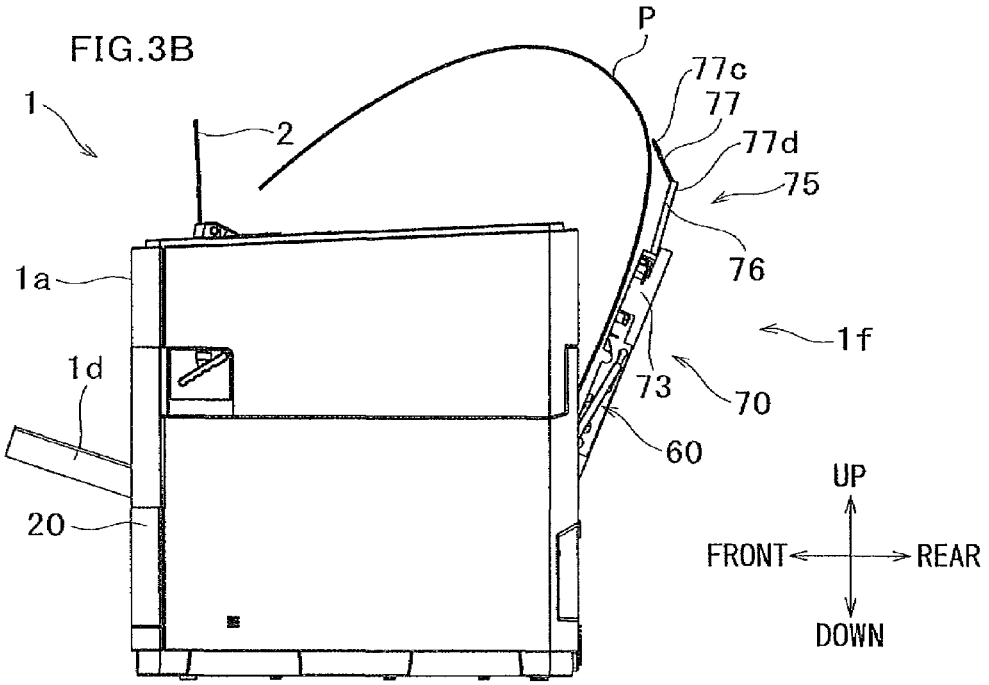
FIG. 3B is a profile of the inkjet printer when the rear cover is in an intermediate state.

For the reason above, in the present embodiment, as shown in FIG. 3B, the rear cover if can be retained in the intermediate state which is between the open state and the closed state, by the retaining mechanism 60. When the rear cover if is retained in the intermediate state, the sheet P discharged from the second discharging slot 46 is guided in the direction along the supporting surface 71*a* of the second sheet discharge tray 70. Furthermore, as compared to the rear cover if retained in the open state, the free end portion of the rear cover 1*f* (second sheet discharge tray 70) is close to the housing 1*a*. This makes it possible to reduce the size of the installation space of the apparatus. Now, the rear cover 1*f*, the retaining mechanism 60, and the switcher 44 will be detailed.

As shown in FIG. 4A to FIG. 6C, the rear cover if includes the second sheet discharge tray 70 and a sub tray 75. The second sheet discharge tray 70 includes a supporting plate 71, a back plate 72, and a pair of side plates 73. The top surface of the supporting plate 71 is the supporting surface 71*a* which is able to support the sheet P discharged from the second discharging slot 46 when the rear cover if is in the open state. The back plate 72 opposes the supporting plate 71, and the rear cover if is in contact with the outside of the housing 1*a* at this back plate 72 when the rear cover if is in the closed state. The paired side plates 73 are provided on the respective sides in the width direction of the second sheet discharge tray 70. The paired side plates 73 extend from the respective ends in the width direction of the back plate 72 toward the respective ends in the width direction of the supporting plate 71, and the leading ends thereof protrude as compared to the supporting surface 71*a*. With this arrangement, the supporting plate 71 and the paired side plates 73 form a concave portion which is capable of housing sheets P. In the meanwhile, the supporting plate 71, the back plate 72, and the paired side plates 73 form a housing space 70*a* (see FIG. 5A) which is capable of housing the sub tray 75.

On the outer side faces of the end portions on the proximal end portion side of the paired side plates 73, protrusions 73*a* are formed to protrude outward in the width direction. In each supporting frame 6 of the housing 1, a shaft hole 1*g* (see FIG. 7A and FIG. 7B) in which each protrusion 73*a* is inserted is formed. The paired shaft holes 1*g* oppose each other in the left-right direction. The second sheet discharge tray 70 (rear cover 1*f*) is supported by the housing 1*a* to be rotatable about the shaft holes 1*g* functioning as a rotational axis, as the respective protrusions 73*a* are inserted into the shaft holes 1*g*. The rotational axis of the second sheet discharge tray 70 is in parallel to the horizontal plane and extends in the left-right direction.

From the inner side surfaces on the inner sides in the width direction of the paired side plates 73, paired guide plates 73*b* and 73*c* (see FIG. 5A) protrude. These paired guide plates 73*b* and 73*c* extend in the longitudinal direction on the free end portion side of the second sheet discharge tray 70, so as to form a guide passage by which the sub tray 75 is guided. Furthermore, at around the center of each side plate 73, a guide hole 73*d* is formed to extend in the longitudinal direction. In this guide hole 73*d*, a later-described fitting protrusion 61*b* of the retaining mechanism 60 is slidably fitted.

The sub tray 75 includes an extension plate 76 and an auxiliary tray 77 each of which is substantially a flat plate in shape. The end portions in the width direction of the extension plate 76 are slidably engaged with the paired guide plates 73*b* and 73*c* of the second sheet discharge tray 70, respectively. These end portions are sandwiched between the paired guide plates 73*b* and 73*c*. As the extension plate 76 slides along the guide plates 73*b* and 73*c* with respect to the second sheet discharge tray 70, the extension plate 76 takes either the storage position (see FIG. 4A) or the drawn position (see FIG. 4B). When the extension plate 76 is in the storage position, the extension plate 76 is entirely housed in the housing space 70*a*. In the meanwhile, when the extension plate 76 is in the drawn position, a part of the extension plate 76 is drawn off from the housing space 70*a*, and the top surface 76*a* of the extension plate 76 becomes continuous with the supporting surface 71*a* of the supporting plate 71 of the second sheet discharge tray 70. When the rear cover if is in the open state and the extension plate 76 is in the drawn position, the sheet P is supported by the top surface 76*a* of the extension plate 76 and the supporting surface 71*a* of the supporting plate 71.

In the top surface 76*a* of the extension plate 76, a concave portion 76*b* capable of housing the auxiliary tray 77 is formed. In the inner side surfaces on the both sides in the left-right direction of the concave portion 76*b*, paired shaft holes 76*c* (see FIG. 5B and FIG. 5C) are formed, respectively. On the respective side surfaces of the ends in the width direction of the auxiliary tray 77, paired protrusions 77*a* are provided. The paired protrusions 77*a* protrude outward in the width direction of the auxiliary tray 77, and are inserted into the paired shaft holes 76*c* of the extension plate 76, respectively. With this arrangement, the auxiliary tray 77 is supported by the extension plate 76 to be rotatable about the paired protrusions 77*a* functioning as a rotational axis. Being similar to the rotational axis of the second sheet discharge tray 70, the rotational axis of the auxiliary tray 77 is in parallel to the horizontal plane and extends in the left-right direction.

Figure 4A:
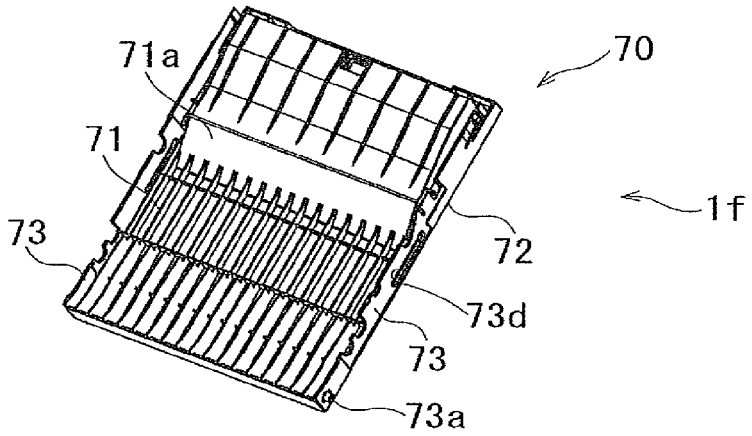
FIG. 4A is an oblique perspective of the rear cover, showing a state in which an extension plate is in a storage position and an auxiliary tray is folded.
Figure 4B:
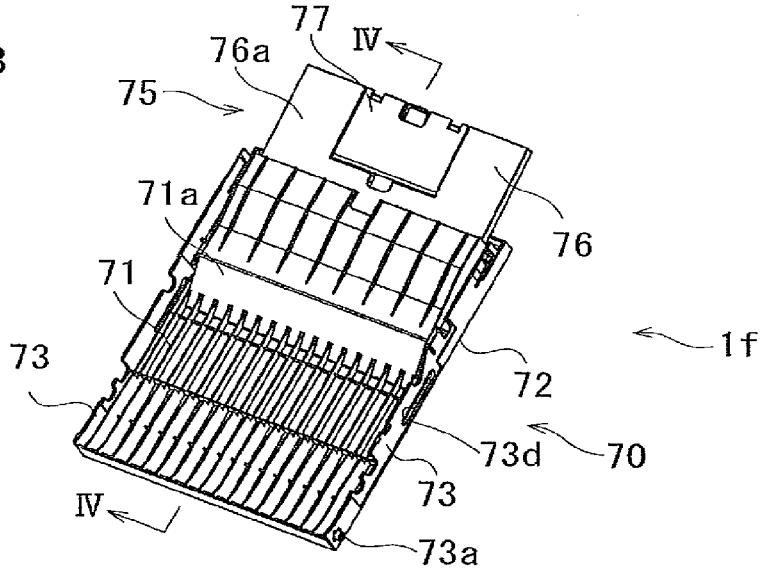
FIG. 4B is an oblique perspective of the rear cover, showing a state in which the extension plate is in a drawn position and the auxiliary tray is folded.
Figure 4C:
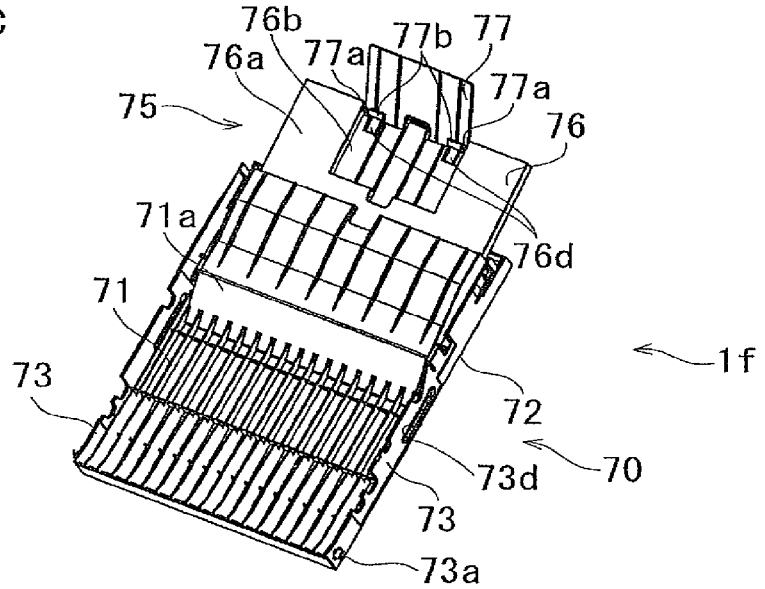
FIG. 4C is an oblique perspective of the rear cover, showing a state in which the extension plate is in the drawn position and the auxiliary tray is unfolded.

The auxiliary tray 77 rotates with respect to the extension plate 76 so as to take a folded state (see FIG. 4B) or an unfolded state (see FIG. 4C). In the folded state, the auxiliary tray 77 is housed in the concave portion 76*b* of the extension plate 76, and is able to support, by the upper surface, the sheet P discharged from the second discharging slot 46. In the meanwhile, in the unfolded state, the auxiliary tray 77 stands on the extension plate 76. In other words, the unfolded state is a state in which the auxiliary tray 77 is rotated upward from the folded state while the second sheet discharge tray 70 is in the open state, and an intersecting angle between the auxiliary tray 77 and the top surface 76*a* of the extension plate 76 (i.e., the supporting surface 71*a* of the supporting plate 71) is larger than the intersecting angle in the folded state.

Figure 5A:
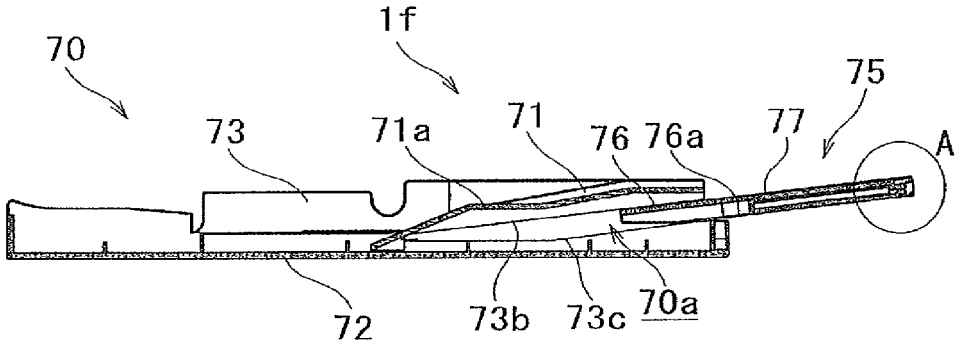
FIG. 5A is a cross section of the rear cover taken at the IV-IV line in FIG. 4B.
Figure 5B:
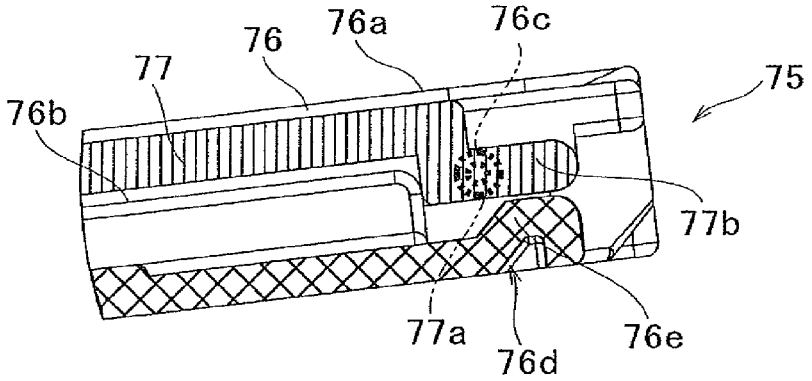
FIG. 5B is an enlarged cross section of the portion A shown in FIG. 5A, when the auxiliary tray is folded.
Figure 5C:
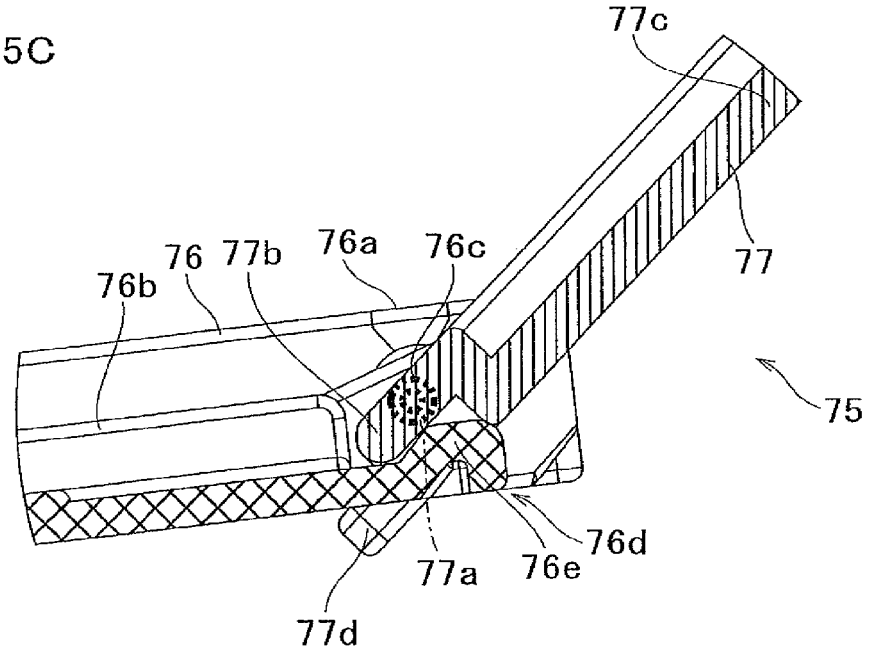
FIG. 5C is an enlarged cross section of the portion A in FIG. 5A, when the auxiliary tray is unfolded.

As shown in FIG. 5A to FIG. 5C, on the bottom wall of the concave portion 76*b* of the extension plate 76, paired rotation prevention members 76*d* which are able to prevent the rotation of the auxiliary tray 77 are formed. The rotation prevention members 76*d* are elastically deformable and each including a protruding portion 76*e*. The auxiliary tray 77 is provided with an engagement portion 77*b* which corresponds to the paired rotation prevention members 76*d* and is able to make contact with the protruding portions 76*e*.

When the auxiliary tray 77 is in the folded state or the unfolded state, the rotation prevention member 76*d* is not elastically deformed and is in a natural state. In this state, when it is attempted to rotate the auxiliary tray 77 with relatively small force, the rotation of the auxiliary tray 77 is prevented by the protruding portions 76*e* because the engagement portion 77*b* of the auxiliary tray 77 makes contact with the protruding portions 76*e* (i.e., the protruding portions 76*e* exist on the movement locus of the engagement portion 77*b*). In the meanwhile, when it is attempted to rotate the auxiliary tray 77 with relatively large force, the engagement portion 77*b* of the auxiliary tray 77 rotates so as to push aside the protruding portions 76*e*, and the entire rotation prevention members 76*d* are warped so that the protruding portions 76*e* move downward in FIG. 5A to FIG. 5C. As a result, the rotation prevention by the rotation prevention members 76*d* of the auxiliary tray 77 is canceled and the rotation from the folded state to the unfolded state or the rotation from the unfolded state to the folded state becomes possible.

Because of the structure above, the auxiliary tray 77 is retained in the unfolded state even if the rear cover 1*f* is switched to the intermediate state while the auxiliary tray 77 is in the unfolded state. Furthermore, as the user rotates the auxiliary tray 77 with predetermined pressure, the rotation state of the auxiliary tray 77 is switched between the folded state and the unfolded state.

As shown in FIG. 3B, when the rear cover if is in the intermediate state and the auxiliary tray 77 is in the unfolded state, the leading end portion 77*c* of the auxiliary tray 77 is above the proximal end portion 77*d* of the auxiliary tray 77 and is forward of the proximal end portion 77*d* (i.e., on the upstream of the proximal end portion 77*d* in the conveyance direction of the sheet P conveyed on the conveying path R5). With this arrangement, after a long sheet P discharged from the second discharging slot 46 is guided along the supporting surface 71*a* of the second sheet discharge tray 70, the long sheet P can be guided to an upper space in the housing 1*a*. On this account, the long sheet P is less likely to fall off from the rear cover if to the outside of the printer 1. Furthermore, because it is no longer necessary to arrange the second sheet discharge tray 70 to be unnecessarily long, the advantage regarding the installation space is further ensured. In this regard, the tilt angle of the auxiliary tray 77 relative to the horizontal plane is adjusted so that the leading end of the long sheet P discharged from the second discharging slot 46 collides with the stopper 2. As a result, the sheet P is less likely to fall off forward of the printer.

Now, the retaining mechanism 60 will be described. As shown in FIG. 6A to FIG. 7B, the retaining mechanism 60 includes members such as a pair of arms 61, a lever 62, and a protrusion 63.

Figure 7A:
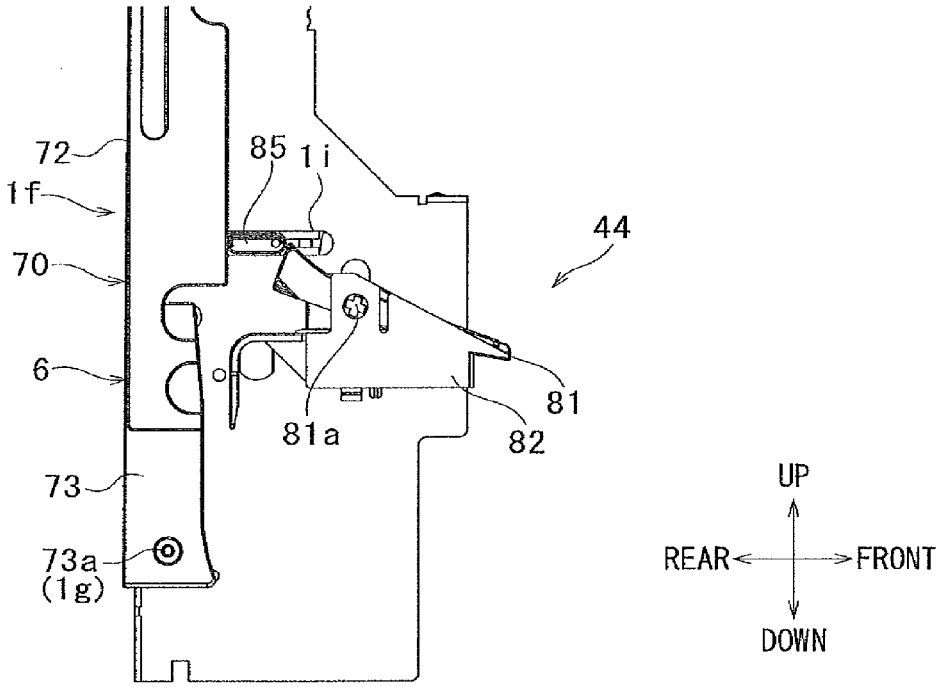
FIG. 7A is a profile of an important part of the inkjet printer around a switcher, showing a state in which the rear cover is in the closed state.
Figure 7B:
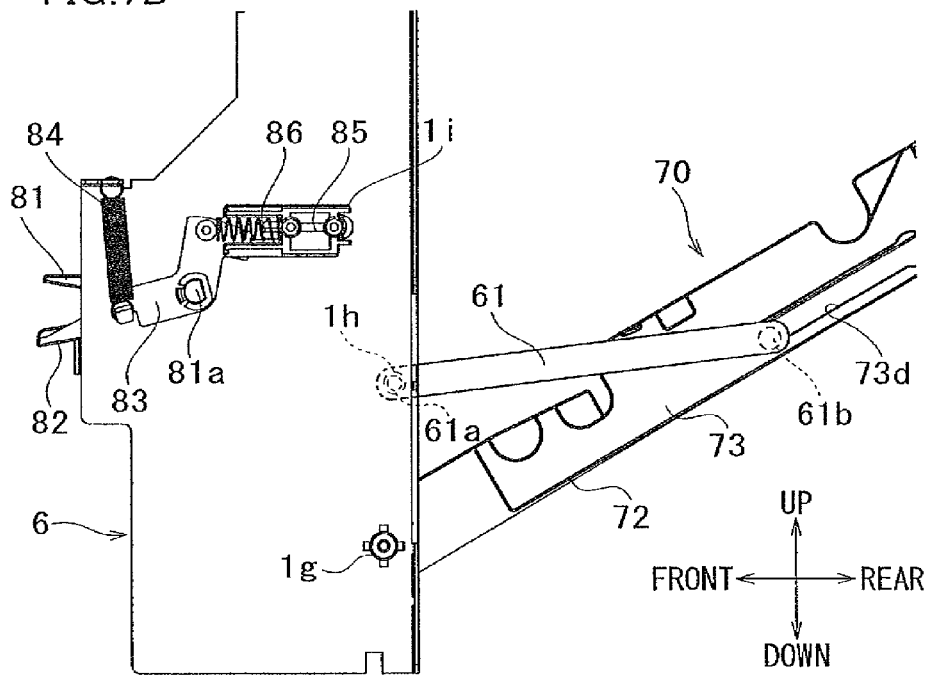
FIG. 7B is a profile of an important part of the inkjet printer around the switcher, showing a state in which the rear cover is in the open state.

As shown in FIG. 7B, each arm 61 is provided at one end with a protrusion 61*a* which protrudes outward in the width direction. In the paired supporting frames 6 of the housing 1*a*, paired shaft holes 1*h* in which the respective protrusions 61*a* are inserted are formed, respectively. Each arm 61 is supported by the housing 1*a* to be rotatable about the protrusion 61*a*, as the paired protrusions 61*a* are inserted into the respective shaft holes 1*h*.

At the other end of each arm 61, a fitting protrusion 61*b* is provided. This fitting protrusion 61*b* is slidably fitted into a guide hole 73*d* which is formed in the side plate 73 of the second sheet discharge tray 70. This fitting protrusion 61*b* moves along the guide hole 73*d* in accordance with the rotation of the rear cover 1*f*. When the rear cover if is in the open state, as shown in FIG. 7B, the fitting protrusion 61*b* is provided at one end on the proximal end side of the guide hole 73*d*. With this, the angle between the rear cover if and the rear surface of the housing 1*a* is retained by the paired arms 61. In other words, the rear cover if is retained in the open state. In the meanwhile, when the rear cover if is in the closed state, the fitting protrusion 61*b* is provided at one end on the free end side of the guide hole 73*d*.

Figure 6A:
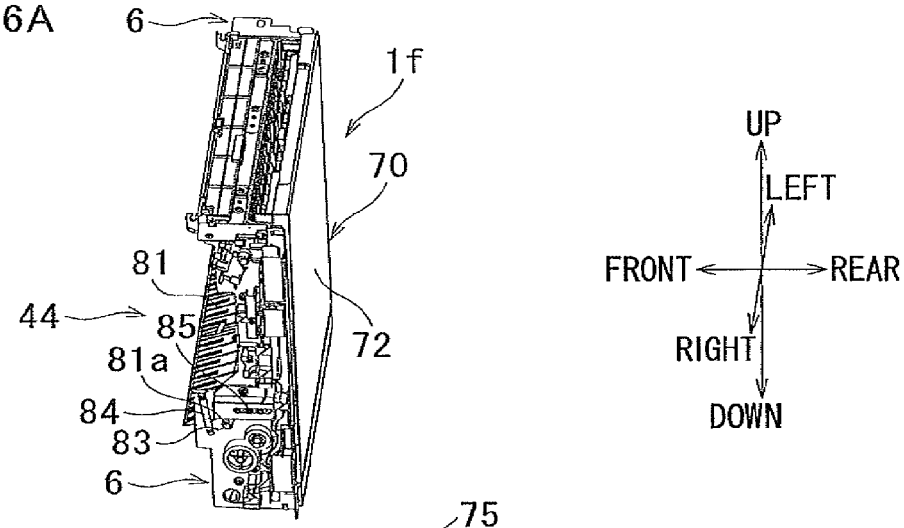
FIG. 6A is an oblique perspective of an important part of the inkjet printer around the rear cover, showing a state in which the rear cover is in a closed state.
Figure 6B:
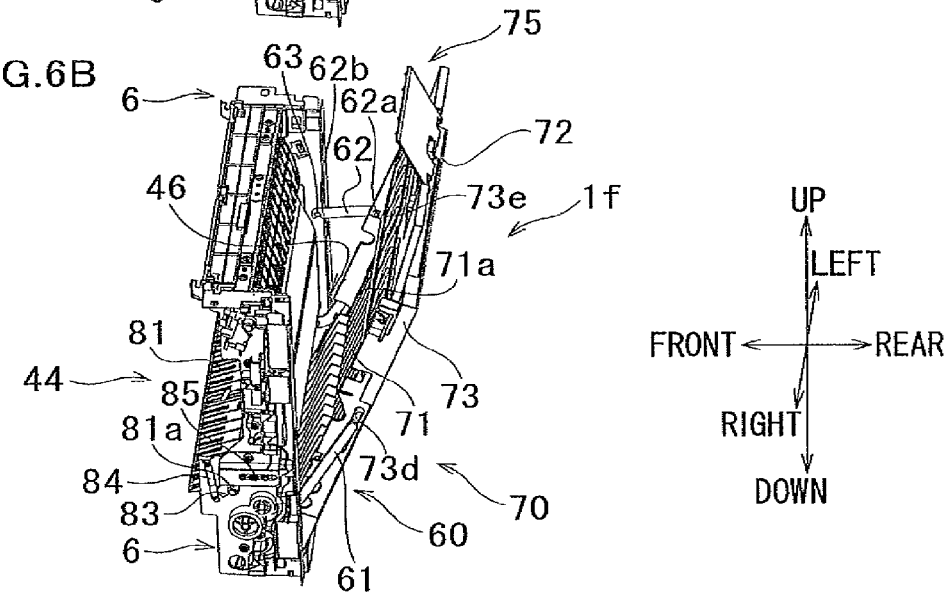
FIG. 6B is an oblique perspective of the important part of the inkjet printer around the rear cover, showing a state in which the rear cover is in the intermediate state.
Figure 6C:
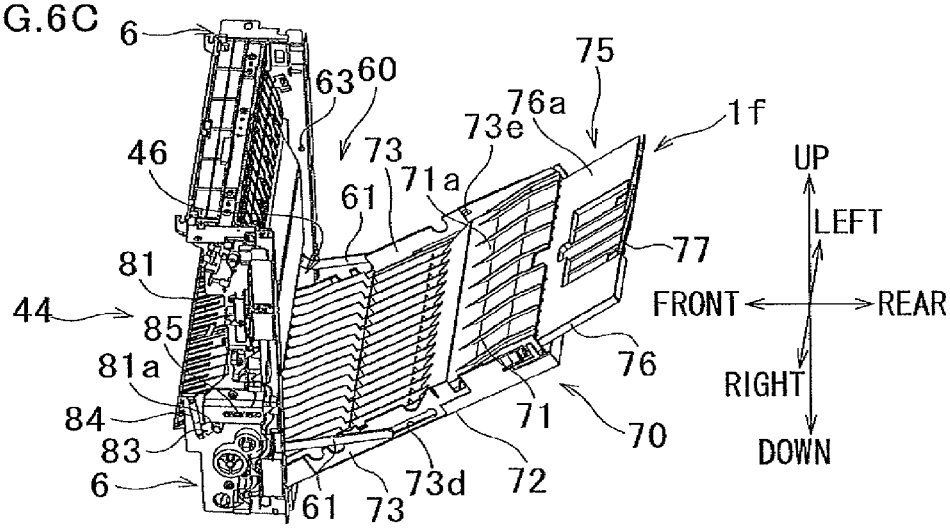
FIG. 6C is an oblique perspective of the important part of the inkjet printer around the rear cover, showing a state in which the rear cover is in the open state.

As shown in FIG. 6A to FIG. 6C, the lever 62 is provided at one end with a protrusion 62*a*. In the side plate 73 which is the left side plate of the second sheet discharge tray 70, a shaft hole 73*e* in which the protrusion 62*a* is inserted is formed. As the protrusion 62*a* is inserted into the shaft hole 73*e*, the lever 62 is supported by the side plate 73 to be rotatable about the protrusion 62*a*. Being similar to the rotational axis of the second sheet discharge tray 70, the rotational axis of the lever 62 is in parallel to the horizontal plane and extends in the left-right direction.

At the end portion on the free end side of the lever 62, a curved hook 62*b* is formed. On the left supporting frame 6, a protrusion 63 (engagement portion) which is able to be engaged with and disengaged from the hook 62*b* is provided. When the user causes the hook 62*b* of the lever 62 to be engaged with the protrusion 63, as shown in FIG. 6B, the rear cover if is retained in the intermediate state. As the user rotates the lever 62 upward in this state, the engagement between the hook 62*b* and the protrusion 63 is canceled and the rotation of the rear cover if is allowed.

In addition to the above, in the present embodiment, an engagement portion is formed at the rear end portion of the top plate of the housing 1*a*, whereas an elastically-deformable hook is formed at the free end portion of the second sheet discharge tray 70. The hook can be engaged with and disengaged from the engagement portion. When the hook is engaged with the engagement portion, the rear cover if is retained in the closed state.

Now, the switcher 44 will be described. As shown in FIG. 7A and FIG. 7B, the switcher 44 includes a flap 81, a supporter 82, a rotational body 83, a tension spring 84, a lever 85, and a compression spring 86. The supporter 82 is provided to be sandwiched between the paired supporting frames 6. The supporter 82 and the housing 1*a* support the flap 81 to be rotatable about the rotational shaft 81*a*. The flap 81 is rotatable about the rotational shaft 81*a* between a first position (see FIG. 7A) and a second position (see FIG. 7B). When the flap 81 is in the first position, the conveyance destination of the sheet P conveyed on the conveying path R3 is the conveying path R4. In the meanwhile, when the flap 81 is in the second position, the conveyance destination of the sheet P conveyed on the conveying path R3 is the conveying path R5.

The rotational body 83 is substantially V-shaped, and is provided on the outer side face in the width direction of the supporting frame 6. The bottom portion of the V shape of the rotational body 83 is fitted with the rotational shaft 81*a* of the flap 81 so as not to be relatively rotatable. One end of the tension spring 84 is fixed to the supporting frame 6, and the other end of the tension spring 84 is fixed to one leading end portion of the V shape of the rotational body 83. The tension spring 84 biases the rotational body 83 so that the rotational body 83 rotates clockwise in FIG. 7B.

The lever 85 is configured to be movable in the front-rear direction on account of a guide 1*i* which is formed in the supporting frame 6 and extends in the front-rear direction. The tail end of the lever 85 functions as an abutting surface with which the second sheet discharge tray 70 makes contact. The tail end of the compression spring 86 is fixed to the leading end of the lever 85, and the leading end of the compressing spring 86 is fixed to the other leading end portion of the V shape of the rotational body 83. This compression spring 86 biases the lever 85 rearward.

According to the arrangement above, when the rear cover if is in the open state or the intermediate state, the rotational body 83 is biased by the tension spring 84 and rotated clockwise in FIG. 7B. Because of the rotation of the rotational body 83, the flap 81 is rotated to take the second position. As a result, the conveyance destination of the sheet P conveyed on the conveying path R3 is set to the conveying path R5. At this stage, the tail end of the lever 85 is not in contact with the second sheet discharge tray 70 and the compression spring 86 is not elastically deformed and in a natural state.

When the user rotates the rear cover if from the open state or the intermediate state to the closed state, the second sheet discharge tray 70 makes contact with the tail end of the lever 85 and moves the lever 85 forward against the biasing force of the compression spring 86. With this, the leading end of the compression spring 86 also moves forward, and hence the rotational body 83 fixed to the compression spring 86 is rotated counterclockwise in FIG. 7B against the biasing force of the tension spring 84. In accordance with this rotation of the rotational body 83, the flap 81 is rotated to take the first position. As a result, the conveyance destination of the sheet P conveyed on the conveying path R3 is set to the conveying path R4.

As described above, in the present embodiment, in accordance with the rotation of the rear cover if by the user, the conveyance destination of sheet P conveyed on the conveying path R3 is switched between the conveying path R4 and the conveying path R5. As a variation, the flap 81 may be configured to be rotatable by a drive motor, and as the controller 100 controls this drive motor, the conveyance destination of the sheet P conveyed on the conveying path R3 may be switched between the conveying path R4 and the conveying path R5.

In the present embodiment, when an image is recorded on a long sheet P, the amount of warpage of the sheet P between the first conveyor 41 and the third conveyor 43 is reduced by setting the conveyance destination of the sheet P conveyed on the conveying path R3 to the conveying path R5, as described above. This restrains the deterioration in the quality of the image recorded on the sheet P. Furthermore, as the second sheet discharge tray 70 is retained in the intermediate state, the free end portion of the second sheet discharge tray 70 is positioned to be close to the housing as compared to the case where the second sheet discharge tray 70 is retained in the open state. Furthermore, the long sheet P discharged from the second discharging slot 46 is guided in the direction along the supporting surface 71*a* of the second sheet discharge tray 70 retained in the intermediate state. This makes it possible to reduce the size of the installation space of the printer 1.

In addition to the above, in the present embodiment, when the second sheet discharge tray 70 is retained in the intermediate state by the retaining mechanism 60, the leading end portion 77*c* of the auxiliary tray 77 is above the proximal end portion 77*d* of the auxiliary tray 77 and on the upstream of the proximal end portion 77*d* in the conveyance direction of the sheet P conveyed on the conveying path R5. With this arrangement, because the long sheet P discharged from the second discharging slot 46 can be guided to the upper space in the housing 1*a*, the long sheet P is less likely to fall off from the second sheet discharge tray 70 to the outside of the apparatus. Furthermore, because it is no longer necessary to arrange the second sheet discharge tray 70 to be unnecessarily long, the advantage regarding the installation space is further ensured.

In addition to the above, according to the present embodiment, the second sheet discharge tray 70 is retained in the intermediate state by simply causing the hook 62*b* of the lever 62 to be engaged with the protrusion 63 of the housing 1*a*.

Figure 8A:
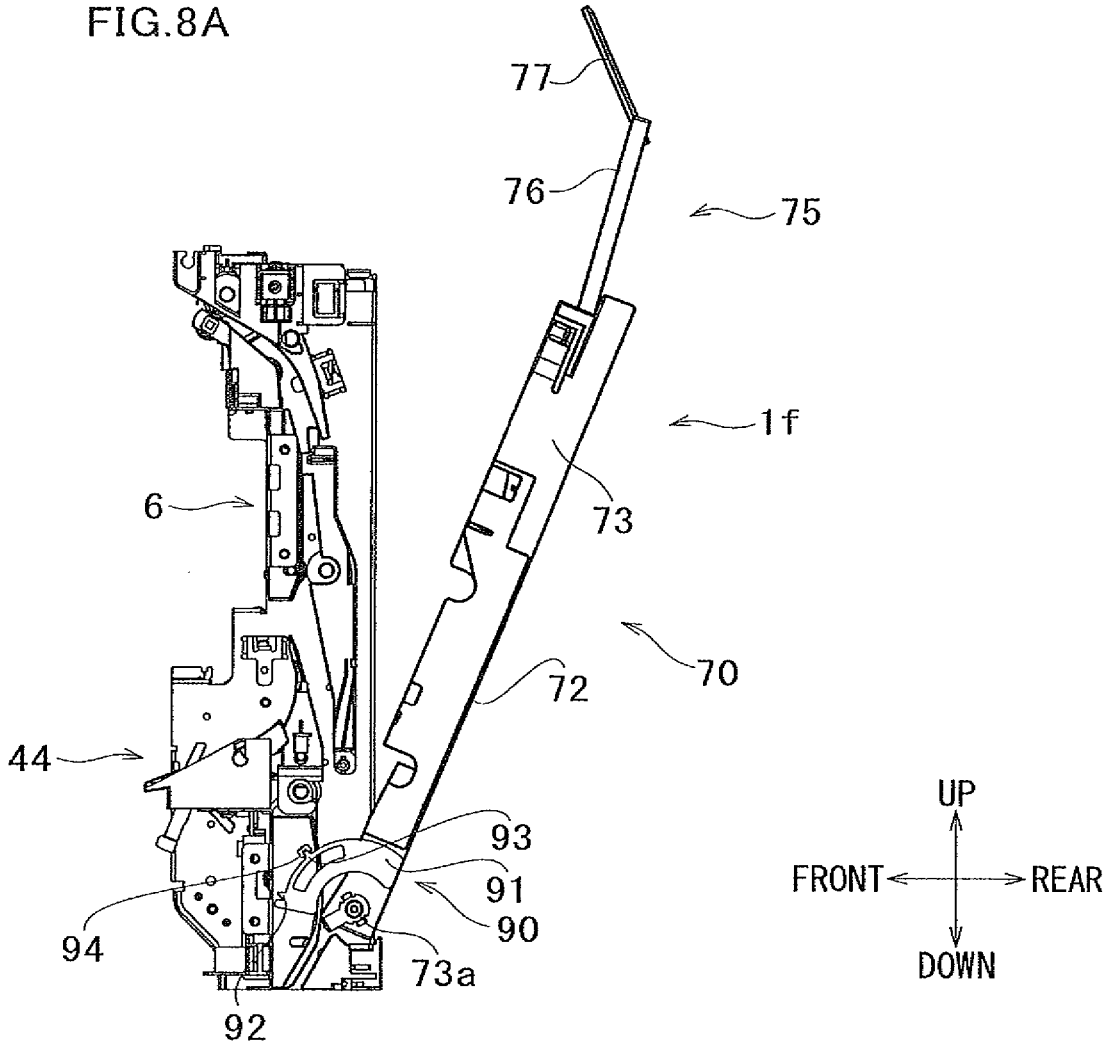
FIG. 8A is a profile of an important part of the inkjet printer around a retaining mechanism according to a variation, showing a state in which the rear cover is in the intermediate state.

Now, variations of the retaining mechanism will be described with reference to FIG. 8A and FIG. 8B. A retaining mechanism 90 of the variation is provided with a rotating component 91, engagement pieces 92 and 93, and an engagement hole 94.

The rotating component 91 is provided on the side plate 73 of the second sheet discharge tray 70 and is configured to be rotatable about the shaft hole 1*g* together with the second sheet discharge tray 70. This rotating component 91 is arch-shaped, and the center of curvature of the rotating component 91 corresponds to that of the shaft hole 1*g*. Each of the engagement pieces 92 and 93 is claw-shaped, and these engagement pieces 92 and 93 are provided at the outer edge of the rotating component 91 at a predetermined interval along the circumferential direction. Each of the engagement pieces 92 and 93 is configured to be elastically deformable. The engagement hole 94 is formed in the supporting frame 6 of the housing 1*a*. This engagement hole 94 is allowed to be engaged with each of the engagement pieces 92 and 93 and is positioned on the movement locus of the engagement pieces 92 and 93.

Figure 8B:
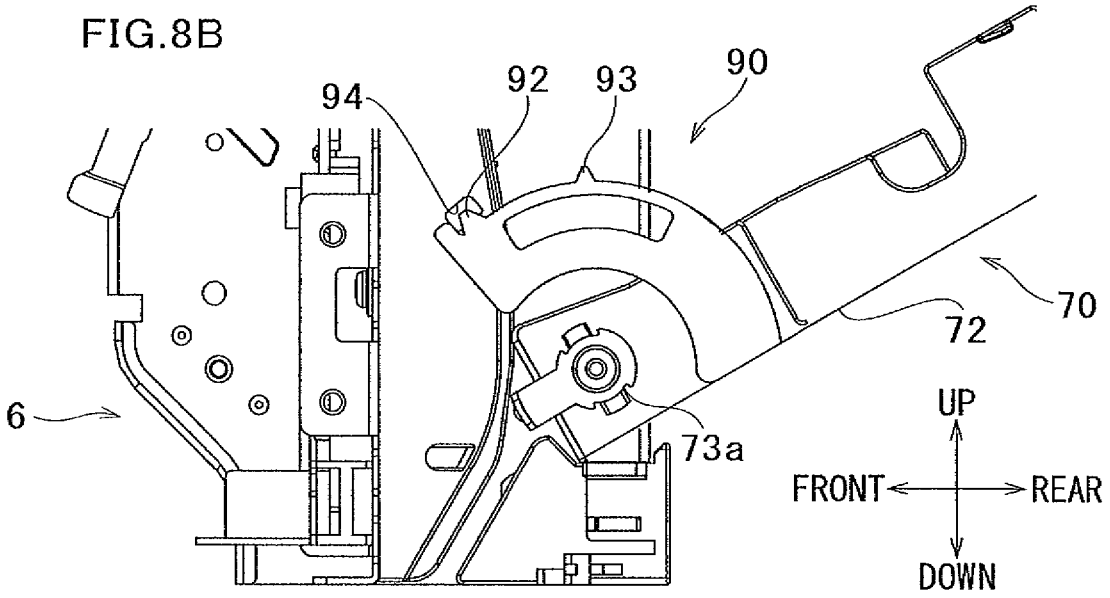
FIG. 8B is a profile of the important part of the inkjet printer around the retaining mechanism according to the variation, showing a state in which the rear cover is in the open state.

As shown in FIG. 8B, when the engagement piece 92 is engaged with the engagement hole 94, the rear cover if is retained in the open state. In the meanwhile, as shown in FIG. 8A, when the engagement piece 93 is engaged with the engagement hole 94, the rear cover if is retained in the intermediate state. When engaged with the engagement hole 94, each of the engagement pieces 92 and 93 is not elastically deformed and is in a natural state. In this state, when the rear cover if is pressed in the rotating direction with relatively low pressure, the engagement piece 92 or 93 is engaged with the engagement hole 94 and hence the rotation of the rear cover if is prevented. In the meanwhile, when the rear cover if is pressed in the rotating direction with relatively high pressure, the engagement piece 92 or 93 is elastically deformed so that the engagement between the engagement piece 92 or 93 and the engagement hole 94 is cancelled, with the result that the rear cover if is allowed to rotate. On this account, as the user rotates the rear cover if with predetermined pressure, the rotation state of the rear cover if is switched between the open state, the intermediate state, and the closed state. In this way, the retaining mechanism 90 of the variation allows the rear cover if to be easily retained in the intermediate state.

According to another variation, the direction in which the ejection surface 10*a* extends is not limited to the horizontal direction (i.e., may extend in, for example, the vertical direction). Furthermore, the conveying paths R3 and R5 may not be in parallel to the horizontal plane, as long as they are linear in shape. The first discharging slot 45 may not be formed in the upper surface of the housing 1*a*, as long as it is formed in an outer wall of the housing 1*a*. Furthermore, the second discharging slot 46 may not be formed in the rear surface of the housing 1*a*, as long as it is formed in a side surface of the housing 1*a*. The conveying path R4 may not be U-shaped. The covering path R4 may be differently shaped, e.g., S-shaped, as long as a part of the covering path R4 is curved.

In addition to the above, while the retaining mechanism 60, 90 is configured to be able retain the rear cover if in a single intermediate state, the retaining mechanism 60, 90 may be able to retain the rear cover if in one of two or more intermediate states. When the rear cover if can be retained in one of two or more intermediate states in this way, the direction in which the long sheet P is discharged from the second discharging slot 46 is diversified. Furthermore, the auxiliary tray 77 may also take one of a plurality of unfolded states which are different from one another in the rotation state. The direction in which the long sheet P is discharged from the second discharging slot 46 is also diversified in this case.

In addition to the above, while the rotation of the rear cover if is performed by the user, a drive motor for rotating the rear cover if may be provided and the rotation of the rear cover if may be done by the controller 100 controlling the drive motor.

In addition to the above, the rear cover if may not be provided with the sub tray 75 (auxiliary tray 77). Furthermore, the auxiliary tray 77 may not be rotatable relative to the extension plate 76, and may be maintained in only one of the folded state and the unfolded state. Furthermore, the structure of the retaining mechanism 60, 90 is not limited to the embodiment above, on condition that the retaining mechanism 60, 90 can be retained in one of a plurality of rotation states which are different from one another in the angle with respect to the side surface of the housing 1*a*.

The heads may eject preprocessing liquid or liquid which is not ink. Furthermore, the number of the heads included in the image recording apparatus is not limited, on condition that it is at least one. The recording medium is not limited to the sheet P, and may be any kinds of recordable media. The present invention may also be employed in image recording apparatuses such as laser printers and thermal printers. Furthermore, the present invention may be employed not only in printers but also in facsimile machines and copying machines.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image recording apparatus comprising:

a conveyance mechanism configured to convey a recording medium in a conveyance direction;

an image recording mechanism configured to record an image onto the recording medium conveyed by the conveyance mechanism;

a housing which houses the conveyance mechanism and the image recording mechanism;

a rotational tray which includes a supporting surface for supporting the recording medium and is attached to the housing to be rotatable with an angle between the rotational tray and a side surface of the housing being changeable; and a retaining mechanism which is able to retain the rotational tray in one of rotation states which are different from one another in the angle with respect to the side surface, the conveyance mechanism including:

a first conveyor which includes a first conveyance passage which is linear in shape and passes a recording position where the image is recorded onto the recording medium by the image recording mechanism, the first conveyor being configured to convey the recording medium at a first conveyance speed along the first conveyance passage;

a second conveyor which includes a first discharging slot formed in an outer wall of the housing and a second conveyance passage extending from an end of the first conveyance passage to the first discharging slot and being at least partially curved, the second conveyor being configured to convey the recording medium along the second conveyance passage at a second conveyance speed lower than the first conveyance speed;

a third conveyor which includes a second discharging slot formed in the side surface of the housing and a third conveyance passage which extends from the end of the first conveyance passage to the second discharging slot, is in parallel to the first conveyance passage, and is linear in shape, the third conveyor being configured to convey the recording medium along third conveyance passage at a third conveyance speed which is less different from the first conveyance speed than the second conveyance speed is from the first conveyance speed; and a switcher configured to switch a conveyance destination of the recording medium conveyed on the first conveyance passage between the second conveyance passage and the third conveyance passage, the retaining mechanism being configured to retain the rotational tray in one of:

an open state in which the second discharging slot is opened and the recording medium discharged from the second discharging slot is supportable by the supporting surface; a closed state in which the second discharging slot is closed by the supporting surface; and an intermediate state between the open state and the closed state, in which the recording medium discharged from the second discharging slot is allowed to be guided in a direction along the supporting surface.

2. The image recording apparatus according to claim 1, further comprising:

an auxiliary tray attached to a free end portion of the rotational tray, when the rotational tray is retained in the intermediate state by the retaining mechanism, the leading end portion of the auxiliary tray being above a proximal end portion of the auxiliary tray and being on the upstream of the proximal end portion in a conveyance direction of the recording medium conveyed on the third conveyance passage.

3. The image recording apparatus according to claim 1, wherein, the retaining mechanism includes:

a rotating component provided on a side wall of the rotational tray to be rotatable together with the rotational tray;

an engagement piece provided on the rotating component to be elastically deformable; and an engagement hole provided in the housing to be engageable with the engagement piece, when the rotational tray is in the intermediate state, the rotational tray is retained in the intermediate state as the engagement piece is engaged with the engagement hole, and when the rotational tray retained in the intermediate state is pressed in a rotational direction of the rotational tray with predetermined pressure, the engagement piece is elastically deformed to be disengaged from the engagement hole.

4. The image recording apparatus according to claim 1, wherein, the retaining mechanism includes:

a lever configured to be rotatable with respect to the side wall of the rotational tray about a rotational axis which is in parallel to a rotational axis of the rotational tray; and an engagement portion provided on the housing, a free end portion of the lever being engaged with or disengaged from the engagement portion, when the free end portion of the lever is engaged with the engagement portion, the rotational tray is retained in the intermediate state.

* * * * *